US011808518B2

(12) United States Patent
Zhao et al.

(10) Patent No.: US 11,808,518 B2
(45) Date of Patent: Nov. 7, 2023

(54) ADVANCED METHOD OF HEAVY HYDROCARBON REMOVAL AND NATURAL GAS LIQUEFACTION USING CLOSED-LOOP REFRIGERATION SYSTEM

(71) Applicant: EnFlex, Inc., Houston, TX (US)

(72) Inventors: James Zhao, Houston, TX (US); Shukui Zhao, Katy, TX (US)

(73) Assignee: EnFlex, Inc., Houston, TX (US)

( * ) Notice: Subject to any disclaimer, the term of this patent is extended or adjusted under 35 U.S.C. 154(b) by 668 days.

(21) Appl. No.: 16/880,419

(22) Filed: May 21, 2020

(65) Prior Publication Data

US 2021/0364231 A1 Nov. 25, 2021

(51) Int. Cl.

| | |
|---|---|
| ***F25J 1/02*** | (2006.01) |
| ***F25J 3/02*** | (2006.01) |
| ***F25J 1/00*** | (2006.01) |

(52) U.S. Cl.

CPC ..... *F25J 1/0214* (2013.01); *F25J 1/0032* (2013.01); *F25J 1/0092* (2013.01); *F25J 3/0209* (2013.01);

(Continued)

(58) Field of Classification Search

CPC ..... F25J 3/0247; F25J 1/0032; F25J 3/0209; F25J 2200/02; F25J 2220/60;

(Continued)

(56) References Cited

U.S. PATENT DOCUMENTS 5,363,655 A * 11/1994 Kikkawa ..... F25J 1/0055 62/613
5,755,114 A * 5/1998 Foglietta ..... F25J 1/0208 62/621

(Continued)

OTHER PUBLICATIONS

Cheng, Chao et al., Performance analysis of compressor unit for mixture refrigerant liquefaction cycle with a separator, Jun. 7, 2016, Elsevier, 803-807 (Year: 2016).*

*Primary Examiner* — John F Pettitt, III
*Assistant Examiner* — Ibrahim A. Michael Adeniji
(74) *Attorney, Agent, or Firm* — Tumey LLP; Eric M. Adams

(57) ABSTRACT

A natural gas liquefaction system and method for effectively and efficiently removing heavy hydrocarbons and converting natural gas into liquefied natural gas. Natural gas streams entering the system may consist of varied gas compositions, pressures, and temperatures. In embodiments the system may comprise a natural gas (NG)-to-liquefied natural gas (LNG) portion and a closed-loop refrigeration portion comprising a closed-loop single mixed refrigerant system. In other embodiments the system may comprise an NG-to-LNG portion and a closed-loop refrigeration portion comprising a closed-loop gaseous nitrogen expansion refrigeration system. All embodiments utilize an integrated heat exchanger with cold-end and warm-end sections and integrated multi-stage compressor and expander configurations (e.g. compander) in order to increase overall operation flexibility and efficiency. This optimized method and system (Continued)

is capable of more efficiently producing a liquefied natural gas product at a desired capacity using a minimum amount of equipment and a modularized design to reduce construction costs.

1 Claim, 8 Drawing Sheets

(52) U.S. Cl.
CPC ..... *F25J 3/0247* (2013.01); *F25J 2200/02* (2013.01); *F25J 2220/60* (2013.01); *F25J 2260/60* (2013.01); *F25J 2270/66* (2013.01)

(58) Field of Classification Search
CPC ..... F25J 2260/60; F25J 1/005; F25J 1/0055; F25J 1/0072; F25J 1/0212; F25J 2220/64; F25J 2230/20; F25J 2230/22; F25J 2230/30; F25J 2270/16; F25J 2290/32; F25J 1/0035; F25J 1/004; F25J 1/0045; F25J 1/0204; F25J 1/0262; F25J 2270/04; F25J 2240/02; F25J 1/0092; F25J 1/0211; F25J 1/2019; F25J 2270/66; F25J 2270/12; F25J 1/0022
USPC ..... 62/612
See application file for complete search history.

(56) References Cited

U.S. PATENT DOCUMENTS

| | | | | |
|---|---|---|---|---|
| 10,072,889 | B2 * | 9/2018 | Lissianski | F25J 1/0022 |
| 2005/0217314 | A1 * | 10/2005 | Baudat | F25J 1/0022 62/613 |
| 2015/0135767 | A1 * | 5/2015 | Currence | F25J 1/0291 62/612 |
| 2017/0343012 | A1 * | 11/2017 | Augy | F04D 19/02 |
| 2021/0190420 | A1 * | 6/2021 | Zhao | F25J 3/062 |
| 2022/0373255 | A1 * | 11/2022 | Ducote, Jr. | F25B 40/00 |

* cited by examiner

ADVANCED METHOD OF HEAVY HYDROCARBON REMOVAL AND NATURAL GAS LIQUEFACTION USING CLOSED-LOOP REFRIGERATION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

The present invention relates to the field of natural gas liquefaction. More particularly, the invention relates to a method of heavy hydrocarbon removal and liquefying natural gas using a closed-loop refrigeration system.

Background of the Invention

A renewed push and demand for using cleaner, cheaper, and locally supplied fuels for transportation and peak-shaving applications has led to natural gas becoming a widely used source for clean fuel. In order to more easily and safely transport and store natural gas, liquefaction processes are performed to convert natural gas to liquefied natural gas (LNG). This in conjunction with the shale gas boom in the United States, has created a boost in building infrastructure for both the domestic natural gas processing capacity and the construction of LNG export terminals. A surge in liquefaction projects, such as these, has stimulated the development of more efficient and innovative LNG liquefaction technologies, which in turn have dramatically lowered the cost of LNG production and provided significant economic savings for consumers.

Currently, there are several methods for liquefying natural gas in practice. Many existing methods and technologies can be relatively inefficient and more expensive due to their process designs, mechanical designs, or their configurations of major equipment. As such, a growth in the development of competitive small-scale liquefaction technologies has occurred in the industry to provide the most efficient, scalable, and flexible modular designs that are best positioned to meet the growing demand for fuels in shipping and trucking industries, as well as the demand for the larger LNG plants used for LNG export.

Consequently, there is a need in the art for an optimized small-scale method and refrigeration system capable of more efficiently producing a liquefied natural gas product at a desired capacity using a minimum amount of equipment and a modularized design to reduce construction costs. The optimized method and refrigeration system need to be both robust and operationally flexible in order to handle variations in feed gas composition and flow rate, while still requiring minimal capital outlay and operating at the lowest possible cost.

BRIEF SUMMARY OF SOME OF THE PREFERRED EMBODIMENTS

These and other needs in the art are addressed in one embodiment by a natural gas liquefaction method comprising: introducing a natural gas stream into a natural gas liquefaction system, wherein the natural gas liquefaction system comprises a natural gas (NG)-to-liquefied natural gas (LNG) portion and a closed-loop refrigeration portion comprising a closed-loop single mixed refrigerant system, wherein the NG-to-LNG portion and the closed-loop refrigeration portion are joined by a heat exchanger; passing the natural gas stream through the NG-to-LNG portion to provide a liquified natural gas stream and a vaporized natural gas liquids stream; and circulating a mixed refrigerant (MR) composition through the closed-loop single mixed refrigerant system to provide cooling to the NG-to-LNG portion.

These and other needs in the art are addressed in one embodiment by a natural gas liquefaction method comprising: introducing a natural gas stream in a natural gas liquefaction system, wherein the natural gas liquefaction system comprises an NG-to-LNG portion and a closed-loop refrigeration portion comprising a closed-loop gaseous nitrogen expansion refrigeration system, wherein the NG-to-LNG portion and the closed-loop refrigeration portion are joined by a heat exchanger; passing the natural gas stream through the NG-to-LNG portion to provide a liquified natural gas stream and a vaporized natural gas liquids stream; and circulating a nitrogen refrigerant through the closed-loop gaseous nitrogen expansion refrigerant system to provide cooling to the NG-to-LNG portion.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
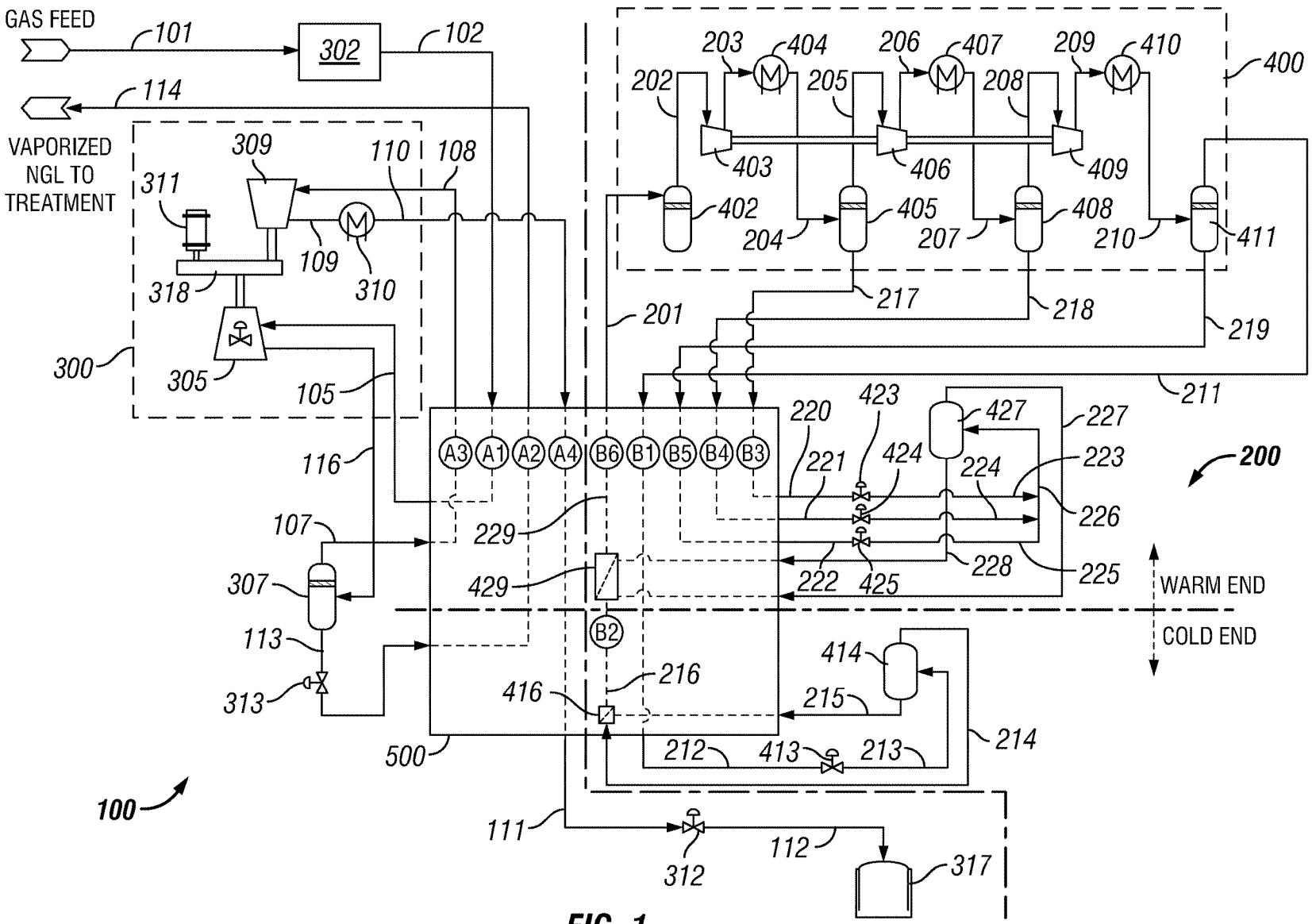
FIG. 1 illustrates an embodiment of a natural gas liquefaction system configured for a high-pressure natural gas feed and a closed-loop mixed refrigerant process.
Figure 2:
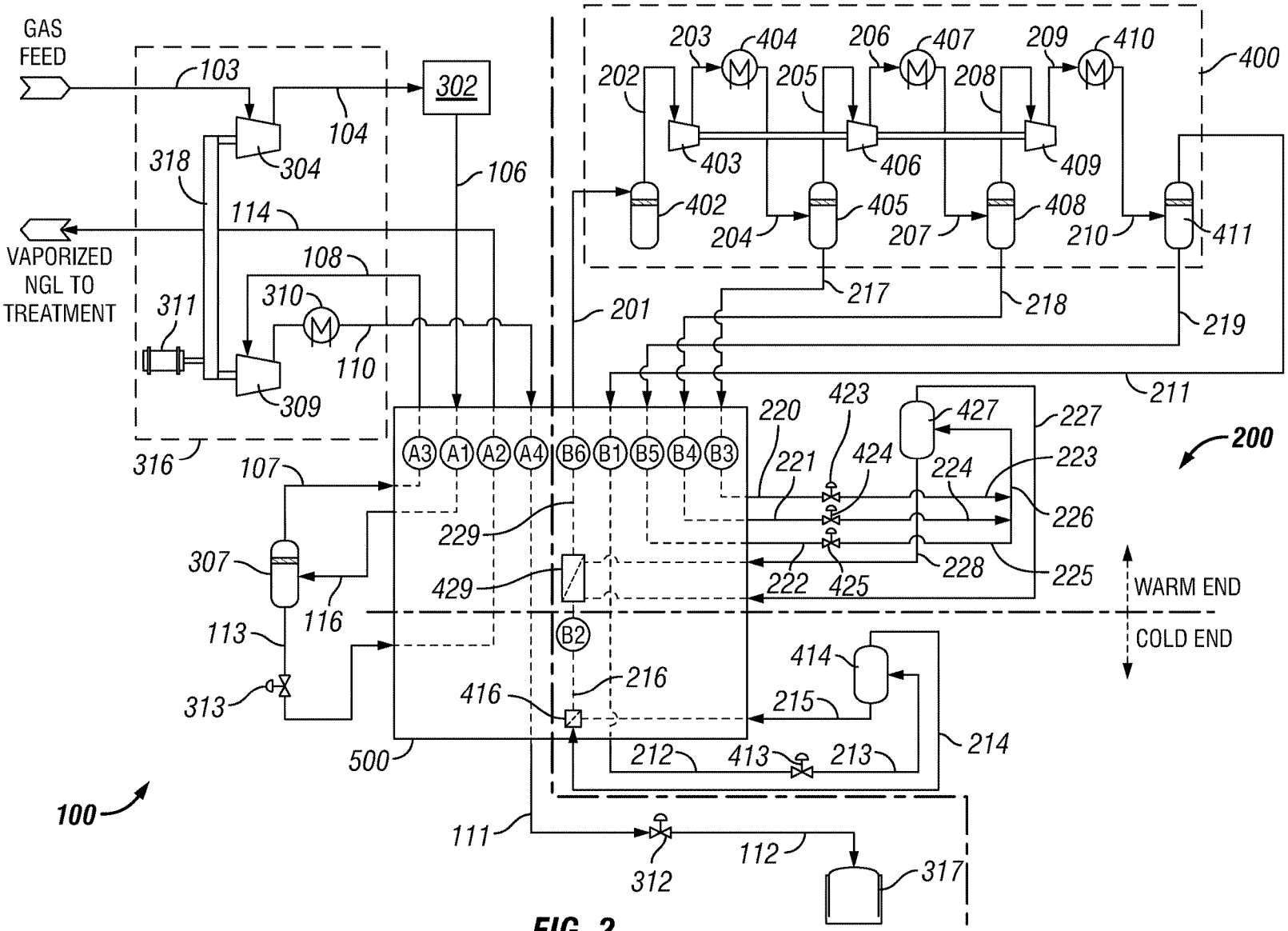
FIG. 2 illustrates an embodiment of a natural gas liquefaction system configured for a low-pressure natural gas feed and a closed-loop mixed refrigerant process.
Figure 3:
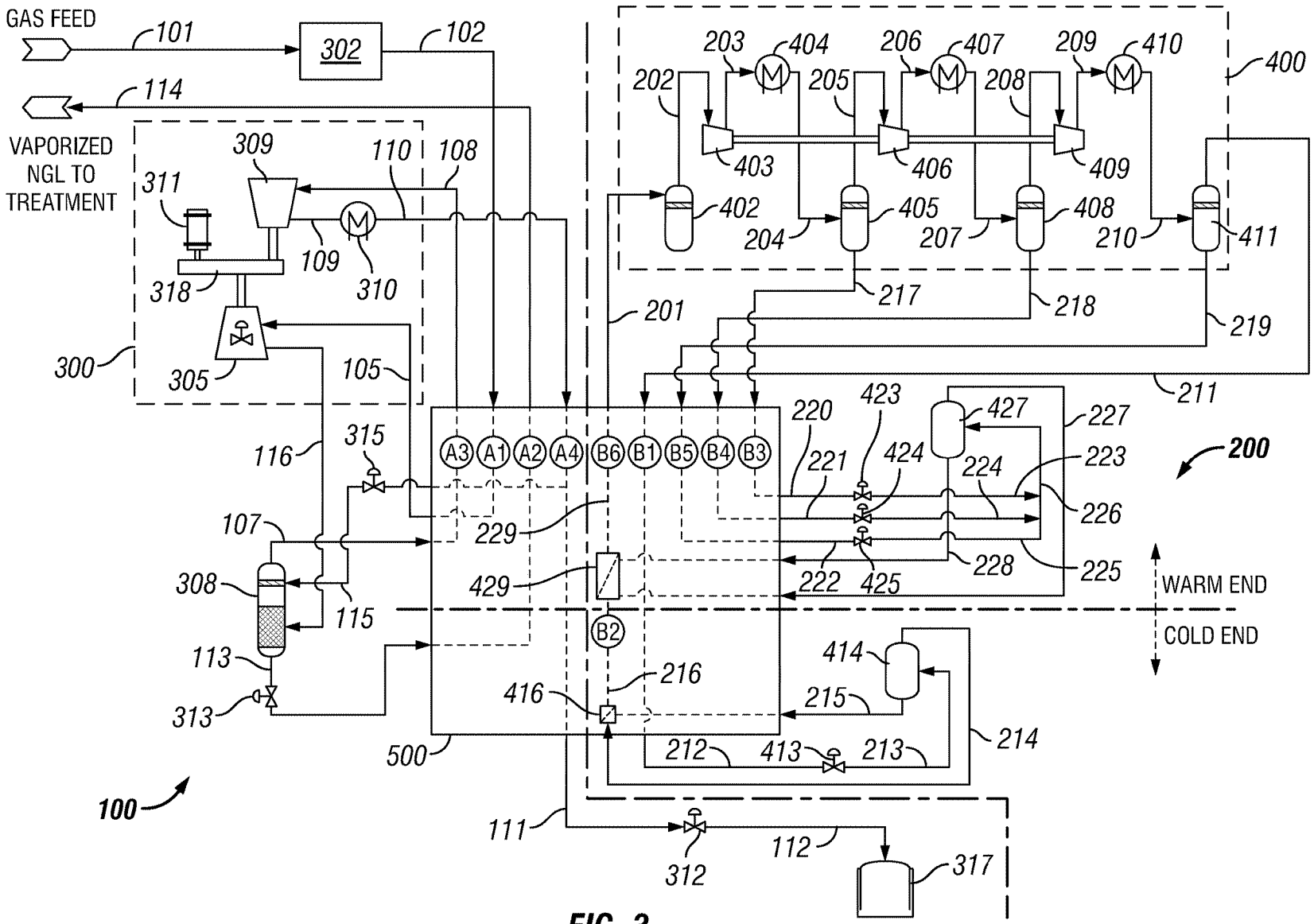
FIG. 3 illustrates an embodiment of a natural gas liquefaction system configured for a high-pressure natural gas feed, a rectifier column with an overhead reflux stream, and a closed-loop mixed refrigerant process.
Figure 4:
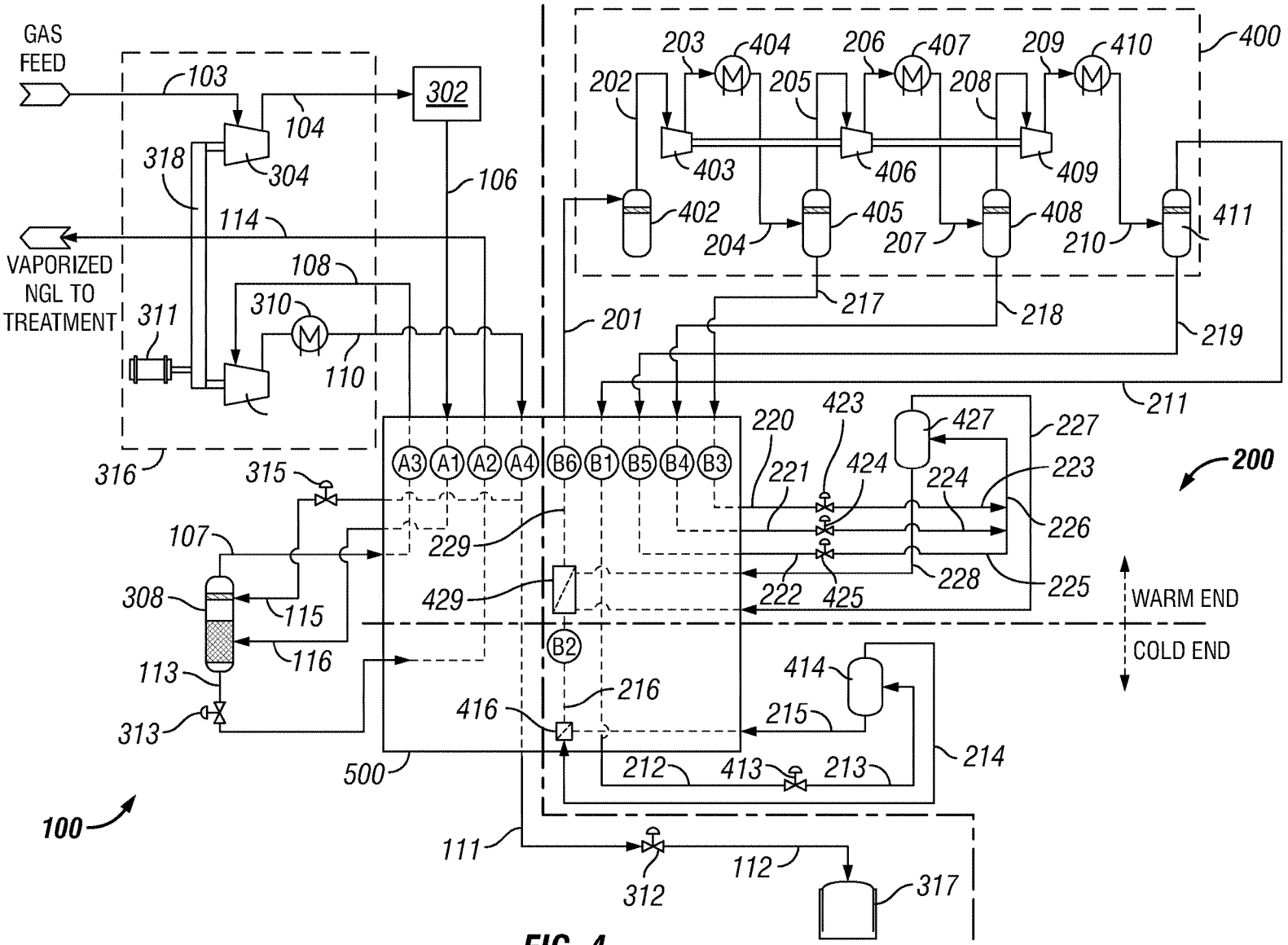
FIG. 4 illustrates an embodiment of a natural gas liquefaction system configured for a low-pressure natural gas feed, a rectifier column with an overhead reflux stream, and a closed-loop mixed refrigerant process.
Figure 5:
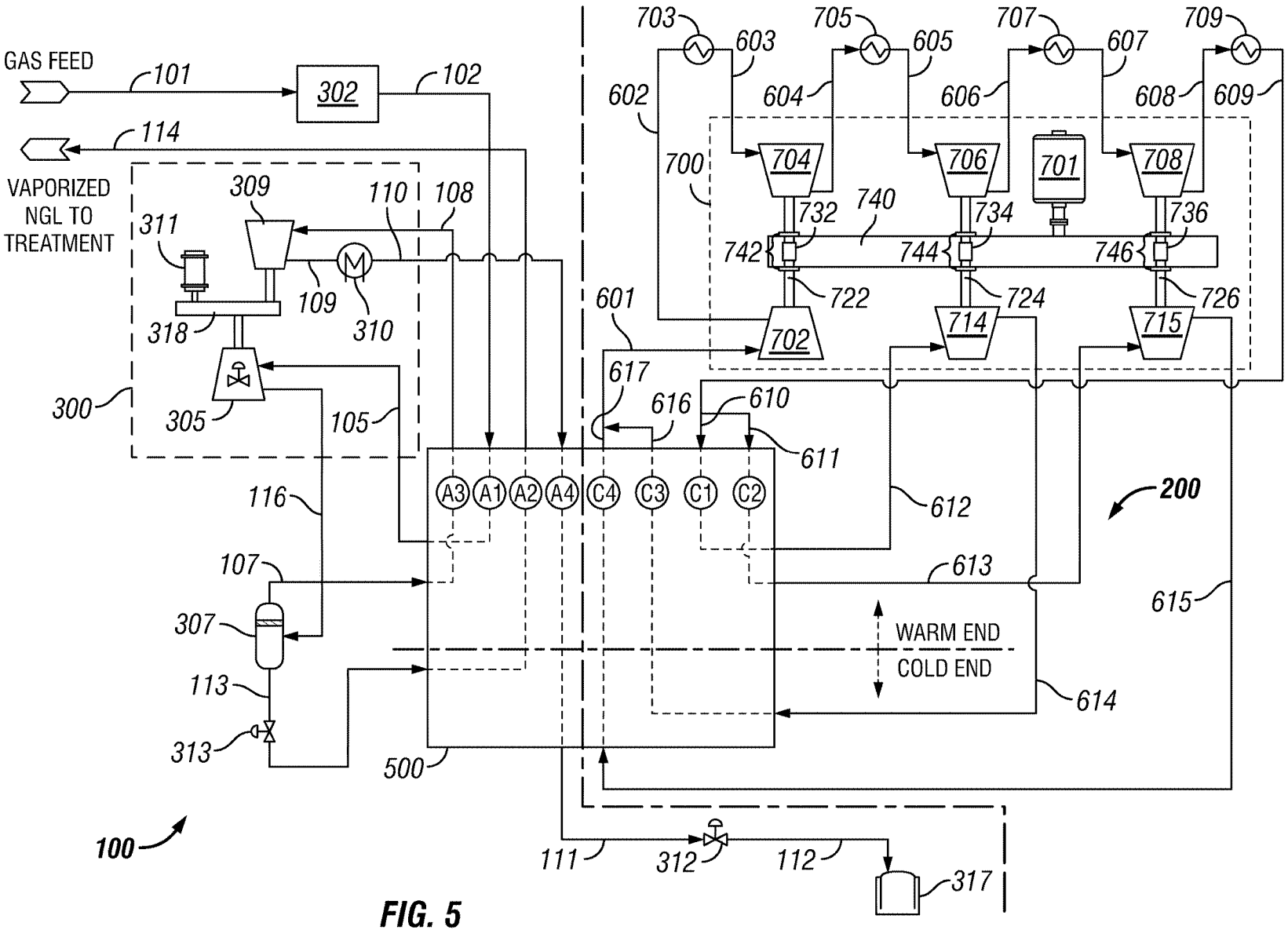
FIG. 5 illustrates an embodiment of a natural gas liquefaction system configured for a high-pressure natural gas feed and a closed-loop nitrogen expansion refrigerant process.
Figure 6:
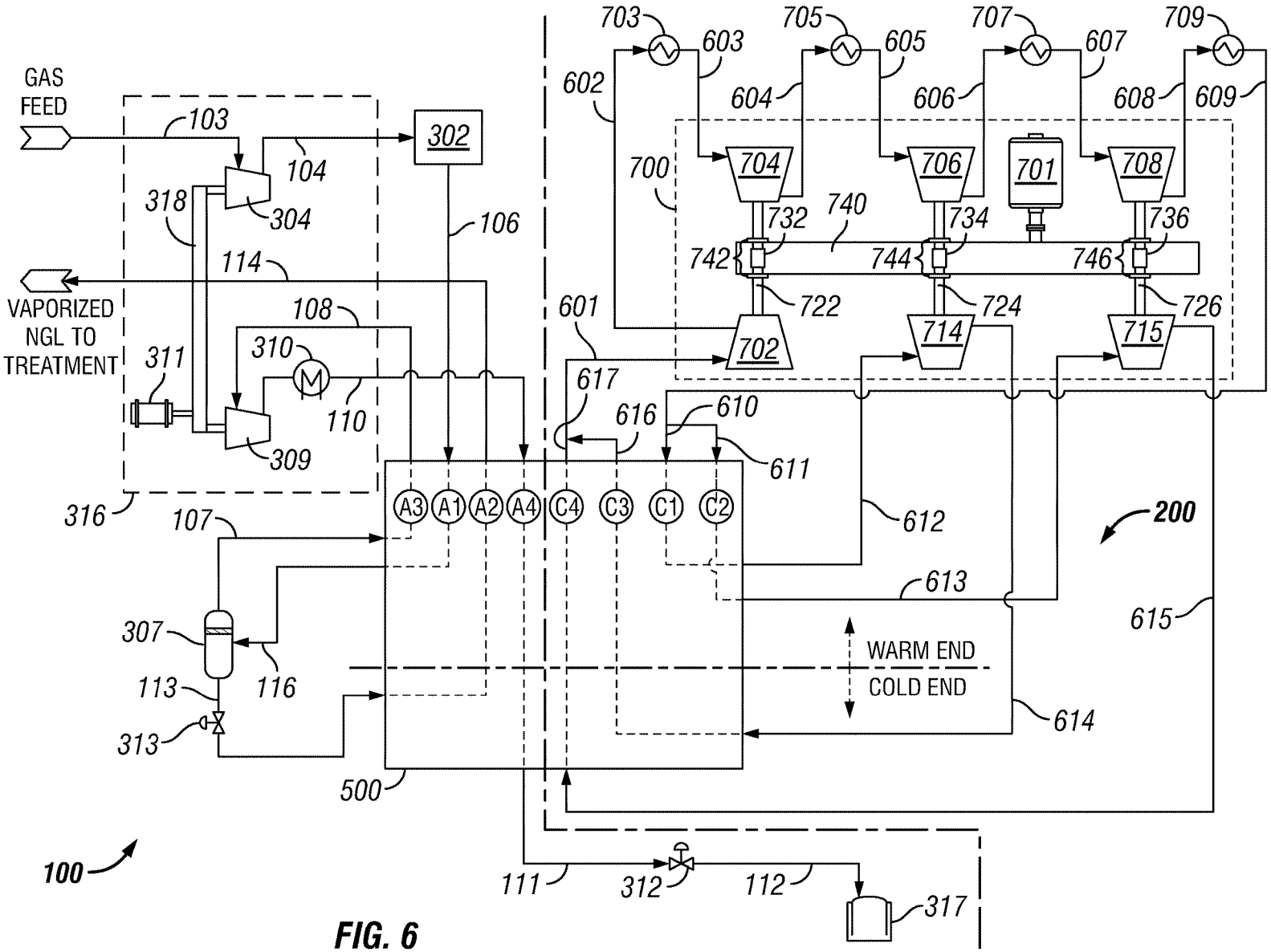
FIG. 6 illustrates an embodiment of a natural gas liquefaction system configured for a low-pressure natural gas feed and a closed-loop nitrogen expansion refrigerant process.
Figure 7:
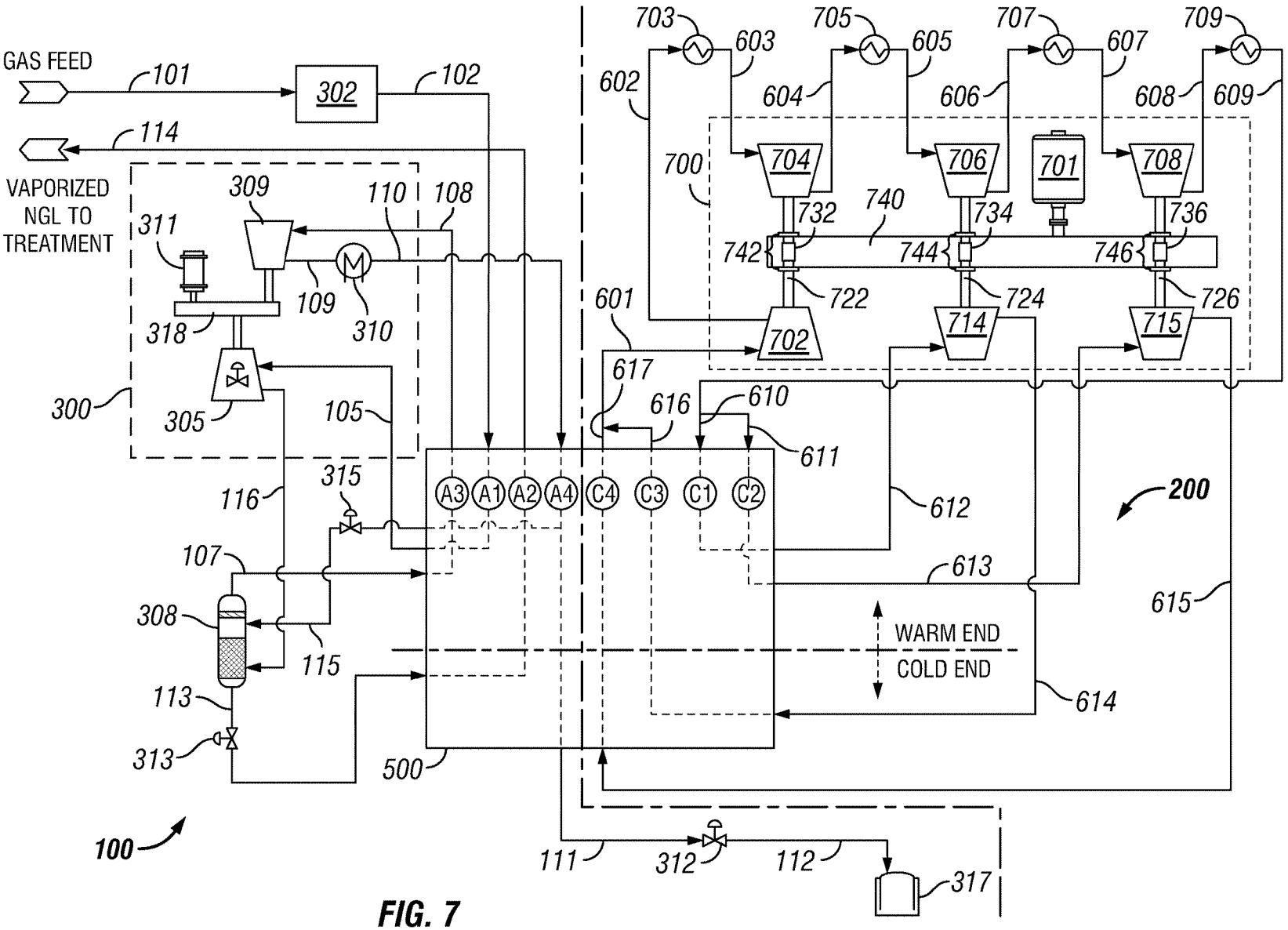
FIG. 7 illustrates an embodiment of a natural gas liquefaction system configured for a high-pressure natural gas feed, a rectifier column with an overhead reflux stream, and a closed-loop nitrogen expansion refrigerant process.
Figure 8:
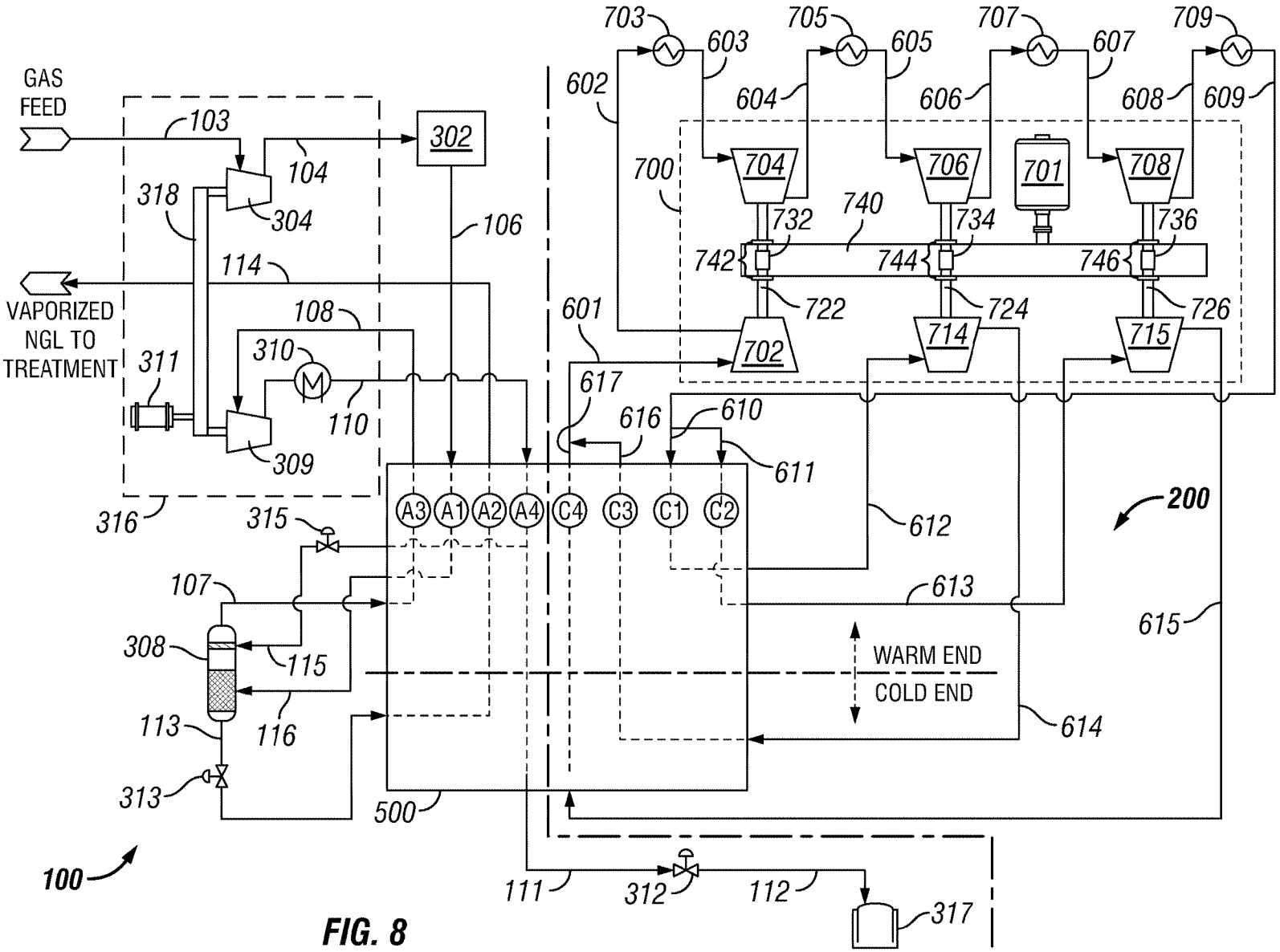
FIG. 8 illustrates an embodiment of a natural gas liquefaction system configured for a low-pressure natural gas feed, a rectifier column with an overhead reflux stream, and a closed-loop nitrogen expansion refrigerant process.

FIGS. 1-8 illustrate embodiments of a natural gas liquefaction system and method. The natural gas liquefaction system and method may effectively and efficiently convert natural gas (NG) into liquefied natural gas (LNG) utilizing a minimal number of heat exchangers, separators, and compressor systems. During operation, natural gas streams entering the system may consist of varied gas compositions, pressures, and temperatures. As such, the natural gas liquefaction system and method may utilize an integrated heat exchanger with cold-end and warm-end sections in order to increase overall operation flexibility and efficiency. With this, the system may be capable of managing fluctuations in feed gas compositions, pressures, and temperatures that may coincide with daily and seasonal ambient temperature changes. Each variant of the natural gas streams may be converted and stored in an LNG storage tank 317 which may be any vessel suitable for LNG storage. Embodiments of the natural gas liquefaction system and method, as illustrated in FIGS. 1-8, may comprise an NG-to-LNG portion 100 and a closed-loop refrigeration portion 200.

In embodiments, NG-to-LNG portion 100 may be configured to accept natural gas streams at any pressure, including both high pressures and low pressures. FIGS. 1, 3, 5 and 7 illustrate embodiments in which a high-pressure natural gas stream 101 may be fed into the natural gas liquefaction system via a natural gas pipeline. High-pressure natural gas stream 101 may comprise methane, ethane, propane, butanes, carbon dioxide, oxygen, nitrogen, hydrogen sulfide, other hydrocarbon components, or any combinations thereof. Further, high-pressure natural gas stream 101 may have a pressure value greater than or equal to about 700 pounds per square inch gauge (psig) and a temperature value corresponding to ambient temperature, between about 50° F. and about 100° F. In embodiments, high-pressure natural gas stream 101 may enter a feed gas front treatment (FGFT) system 302 and exit as a treated high-pressure natural gas stream 102. FGFT system 302 may remove acid gases (e.g. carbon dioxide and hydrogen sulfide), water, and other contaminants (e.g. mercury) from high-pressure natural gas stream 101. Removal of such components may prevent freezing and/or damage from occurring in the natural gas liquefaction system. In embodiments, treated high-pressure natural gas stream 102, which is free of certain contaminants, may comprise less than about 50 parts per million volume (ppmv) of carbon dioxide concentration, less than about 0.5 to about 1.0 ppmv of water concentration, and less than about 0.01 $\mu g/Nm^3$ of mercury. Further, treated high-pressure natural gas stream 102 may maintain the same or similar pressure and temperature values as that of high-pressure natural gas stream 101.

In embodiments, treated high-pressure natural gas stream 102, being free of contaminants, may enter a first pass A1 of a main heat exchanger 500 and exit as a cooled high-pressure natural gas stream 105. Main heat exchanger 500 may be a brazed aluminum heat exchanger (BAHX) with minimum stream temperature approaches as low as 3° F. Further, main heat exchanger 500 may comprise a warm-end and a cold-end which may correspond to temperature within the heat exchanger, the highest temperatures being at the top of the warm-end and the lowest temperatures being at the bottom of the cold-end. In embodiments, first pass A1 may be a natural gas path disposed within main heat exchanger 500 beginning at the top of the warm-end and ending at a point below the top of the warm-end and above the cold-end. As such, treated high-pressure natural gas stream 102 may be cooled and/or partially-condensed by main heat exchanger 500 as it travels through first pass A1. In embodiments, the resulting cooled high-pressure natural gas stream 105 may have a reduced temperature between about −25° F. and about 10° F.

In embodiments, due to the high-pressure value of cooled high-pressure natural gas stream 105, the stream may enter a first pressure reduction device 305 and exit as a cold partially-condensed natural gas stream 116. In embodiments, first pressure reduction device 305 may be a pressure let-down valve or a natural gas expander system capable of reducing the pressure of cooled high-pressure natural gas stream 105 to an optimal pressure between about 400 psig and about 600 psig. In embodiments in which first pressure reduction device 305 may be a natural gas expander system, the natural gas expander system may be equipped with a vapor/liquid separator at its inlet (not illustrated) in order to prevent any potential liquid from entering the natural gas expander system. Further, first pressure reduction device 305 may be an optional component of NG-to-LNG portion 100, particularly when high-pressure natural gas stream 101 is already at the optimal pressure. In addition to reaching the optimal pressure, the resulting cold partially-condensed natural gas stream 116 may reach an optimal temperature between about −120° F. to about −80° F. upon exiting first pressure reduction device 305. In embodiments, this combination of optimal pressure and optimal temperature for stream 116 may allow for effective removal of heavy hydrocarbons in a vapor/liquid separator or a rectification column disposed within the natural gas liquefaction system, and thus may further prevent freezing and/or damage from occurring in the system.

FIGS. 2, 4, 6 and 8 illustrate embodiments in which a low-pressure natural gas stream 103 may be fed into the natural gas liquefaction system via a natural gas pipeline. Similarly to high-pressure natural gas stream 101, low-pressure natural gas stream 103 may comprise methane, ethane, propane, butanes, carbon dioxide, oxygen, nitrogen, hydrogen sulfide, other hydrocarbon components, or any combinations thereof. Further, low-pressure natural gas stream 103 may have a pressure value less than 400 psig and a temperature value corresponding to ambient temperature, between about 50° F. and about 100° F. Due to the low-pressure value of low-pressure natural gas stream 103, the stream may enter a first pressure booster device 304 and exit as a pressure-increased natural gas stream 104. In embodiments, first pressure booster device 304 may be a booster compressor system capable of increasing the pressure of low-pressure natural gas stream 103 to the optimal pressure between about 400 psig and about 600 psig. First pressure booster device 304 may be an optional component of NG-to-LNG portion 100, particularly when low-pressure natural gas stream 103 is already at the optimal pressure.

In embodiments, pressure-increased natural gas stream 104, which is at the optimal pressure, may enter FGFT system 302 and exit as a treated pressure-increased natural gas stream 106. Similarly to above, FGFT system 302 may remove acid gases (e.g. carbon dioxide and hydrogen sulfide), water, and other contaminants (e.g. mercury) from pressure-increased natural gas stream 104. Removal of such components may further prevent freezing and/or damage from occurring in the natural gas liquefaction system. In embodiments, treated pressure-increased natural gas stream 106, which is free of certain contaminants, may comprise less than about 50 ppmv of carbon dioxide concentration, less than about 0.5 to about 1.0 ppmv of water concentration, and less than about 0.01 $\mu gNm^3$ of mercury.

In embodiments, treated pressure-increased natural gas stream 106, being at the optimal pressure and free of contaminants, may enter first pass A1 of main heat exchanger 500 and exit as cold partially-condensed natural gas stream 116. In embodiments, as set forth above, first pass A1 may be a natural gas path disposed within main heat exchanger 500 beginning at the top of the warm-end and ending at a point below the top of the warm-end and above the cold-end. As such, treated pressure-increased natural gas stream 106 may be cooled by main heat exchanger 500 as it travels through first pass A1. In embodiments, the resulting cold partially-condensed natural gas stream 116 may reach the optimal temperature between about −120° F. to about −80° F. Again, this combination of optimal pressure and optimal temperature for stream 116 may allow for effective removal of heavy hydrocarbons in a vapor/liquid separator or a rectification column disposed within the natural gas liquefaction system, and thus may further prevent freezing and/or damage from occurring in the system.

In embodiments, as illustrated in FIGS. 1-8, cold partially-condensed natural gas stream 116, being free of contaminants, at the optimal pressure and temperature, and further comprising a vapor and a liquid portion, may enter a cold gas separator 307 and exit as two separate product streams: a vapor product stream 107 and a liquid product stream 113, wherein vapor product stream 107 primarily contains light hydrocarbon components, and wherein liquid product stream 113 primarily contains heavy hydrocarbon components. Cold gas separator 307 may be a standard vapor/liquid flash separation vessel or a heavy hydrocarbon (HHC) removal rectifier column, deliberately selected and maintained at the optimal pressure. As such, cold gas separator 307 may effectively separate the vapor portion and the liquid portion of cold partially-condensed natural gas stream 116 and in doing so may separate the light hydrocarbon components and the heavy hydrocarbon components. As set forth above, removal of the heavy hydrocarbon components from the stream may prevent the components from freezing downstream in the natural gas liquefaction system. The heavy hydrocarbon components may comprise, without limitation, hexanes (e.g. hexane+), BTEX (e.g. benzene, toluene, e-benzene, xylenes), other heavy hydrocarbon components, or any combinations thereof. The light hydrocarbon components may comprise, without limitation, methane, ethane, propane, butanes, pentanes, other light hydrocarbon components, or any combinations thereof. Further in embodiments, vapor product stream 107 may have low heavy hydrocarbon component levels at less than about 100 ppmv of hexane+ concentration and less than about 1 ppmv BTEX concentration, while liquid product stream 113 may comprise a majority of heavy hydrocarbon components in liquid form.

In embodiments, liquid product stream 113, having high levels of heavy hydrocarbon components and a low temperature between about −120° F. to about −80° F., may enter a second pass A2 of main heat exchanger 500 and exit as a vaporized natural gas liquid (NGL) stream 114. In embodiments, liquid product stream 113 may be routed to main heat exchanger 500 by a level control valve 313. Level control valve 313 may be any level control valve suitable for monitoring and responding to the level, volume, and/or height of liquid product stream 113, thereby enabling an appropriate amount of the stream to be directed toward second pass A2. In embodiments, second pass A2 may be a natural gas liquid path disposed within main heat exchanger 500 beginning at a point above the bottom of the cold-end below the warm-end and ending at the top of the warm-end. As such, liquid product stream 113 may provide cooling to the warm passes disposed within main heat exchanger 500, while simultaneously being warmed and vaporized as it travels through second pass A2. In embodiments, the resulting vaporized NGL stream 114, having been warmed to a temperature close to any warm streams entering the warm-end of main heat exchanger 500, may be fully or partially vaporized. In embodiments, streams entering the warm-end of main heat exchanger 500 may be any temperature greater than those at the cold-end of main heat exchanger 500. After vaporization, vaporized NGL stream 114 may be routed out of the natural gas liquefaction system and sent for further treatments as needed. Treatments may include, without limitation, NGL separation, LPG separation, or any combinations thereof.

In embodiments, vapor product stream 107, having low level contents of heavy hydrocarbons and a low temperature between about −120° F. to about −80° F., may enter a third pass A3 of main heat exchanger 500 and exit as a warmed vapor product stream 108. Third pass A3 may be a natural gas path disposed within main heat exchanger 500 beginning at a point below the top of the warm-end and above the cold-end and ending at the top of the warm-end. As such, vapor product stream 107 may provide cooling to the warm passes disposed within main heat exchanger 500, while simultaneously being warmed as it travels through third pass A3. In embodiments, the resulting warmed vapor product stream 108 may have an increased temperature close to any warm streams entering the warm-end of main heat exchanger 500. This temperature increase may prepare warmed vapor product stream 108 for entry into a second pressure booster device 309, which may then exit as a compressed vapor stream 109. In embodiments, second pressure booster device 309 may be a single stage or a multi-stage booster compressor system with a cooler at each compressor stage discharge, capable of increasing the pressure of warmed vapor product stream 108 to a pressure between about 800 psig and about 1100 psig. This pressure increase may significantly increase the energy efficiency of the natural gas liquefaction system. In embodiments, compressed vapor stream 109, having an increased pressure, may enter a cooling device 310 and exit as a de-superheated compressed vapor stream 110. Cooling device 310 may be any standard vapor cooling system capable of lowering the temperature of compressed vapor stream 109. In embodiments, the temperature of de-superheated compressed vapor stream 110 may be dependent upon the cooling medium of cooling device 310. For example, if the cooling medium is ambient air, the temperature of de-superheated compressed vapor stream 110 may be between about 80° F. and about 120° F. Lowering the temperature of compressed vapor stream 109 before entry into main heat exchanger 500 may minimized the amount of energy needed to liquefy the stream.

In embodiments in which high-pressure natural gas stream 101 may be fed into the natural gas liquefaction system, as illustrated in FIGS. 1, 3, 5, and 7, first pressure reduction device 305 and second pressure booster device 309 may be integrated by a bull-gear 318 that may be driven by a motor or turbine 311 to form an integrated feed gas compander 300. In embodiments in which low-pressure natural gas stream 103 may be fed into the natural gas liquefaction system, as illustrated in FIGS. 2, 4, 6 and 8, first pressure booster device 304 and second pressure booster device 309 may be integrated by bull-gear 318 as a multi-stage compressor system driven by motor or turbine 311 to form an integrated feed gas booster compressor system 316. Both integrated feed gas compander 300 and integrated feed gas booster compressor system 316 may incorporate cooling device 310.

In embodiments, de-superheated compressed vapor stream 110, having an increased pressure between about 800 psig and about 1100 psig and a temperature between about 80° F. to about 120° F., may enter a fourth pass A4 of main heat exchanger 500 and exit as a liquefied natural gas stream 111. Fourth pass A4 may be a natural gas path disposed within main heat exchanger 500 beginning at the top of the warm-end and ending at the bottom of the cold-end. As such, de-superheated compressed vapor stream 110 may be further cooled by main heat exchanger 500 as it travels through fourth pass A4. In embodiments, fourth pass A4 may be cooled by the cold natural gas passes A3 and A2, and refrigerant passes disposed within main heat exchanger 500. The resulting liquefied natural gas stream 111 may have a final temperature between about −250° F. to about −265° F., allowing for complete liquefaction of de-superheated compressed vapor stream 110. Due to its high pressure between about 800 psig and about 1100 psig, liquefied natural gas stream 111, may enter a first flow control valve 312 and exit as a pressure-reduced liquefied natural gas stream 112. First flow control valve 312 may be any flow control valve suitable for regulating the flow or pressure of liquefied natural gas stream 111. In embodiments, pressure-reduced liquefied natural gas stream 112 may have a decreased pressure between about 1 psig and about 20 psig, which may be a suitable pressure for storing pressure-reduced liquefied natural gas stream 112 in LNG storage tank 317 as well as for transporting pressure-reduced liquefied natural gas stream 112 in LNG storage tank 317.

In certain embodiments, as illustrated in FIGS. 3, 4, 7, and 8, cold gas separator 307 of the natural gas liquefaction system may be designed as an HHC removal rectifier column 308 comprising an overhead reflux stream 115. Overhead reflux stream 115 may originate from the middle of fourth pass A4 of main heat exchanger 500 and enter HHC removal rectifier column 308. Further, overhead reflux stream 115 may be maintained by a second flow control valve 315. In embodiments, second flow control valve 315 may be any flow control valve suitable for regulating the flow or pressure of overhead flux stream 115. The addition of overhead reflux stream 115 may contribute to a refined heavy hydrocarbon removal process in HHC removal rectifier 308 such that vapor product stream 107 may meet certain quality requirements such as hexane+ concentrations less than 100 ppmv and BETX concentrations less than 1 ppmv.

In embodiments, closed-loop refrigeration portion 200 may be configured to provide cooling to the natural gas passes disposed within main heat exchanger 500, particularly to first pass A1 which cools treated high-pressure natural gas stream 102 as illustrated in FIGS. 1, 3, 5, and 7 or treated pressure-increased natural gas stream 106 as illustrated in FIGS. 2, 4, 6, and 8, and to fourth pass A4 which cools de-superheated compressed vapor stream 110 to its final temperature. To provide cooling, closed-loop refrigeration portion 200 may comprise a closed-loop single mixed refrigerant system or a closed-loop gaseous nitrogen expansion refrigeration system.

FIGS. 1-4 illustrate embodiments of the natural gas liquefaction system in which closed-loop refrigeration portion 200 comprises the closed-loop single mixed refrigerant system. In embodiments, the closed-loop single mixed refrigerant system may utilize and circulate a mixed refrigerant (MR) composition comprising nitrogen and more than one hydrocarbon component such as methane, ethane, ethylene, propane, butanes, iso-pentane, or any combinations thereof. An example of an MR composition may be a mixture of nitrogen, methane, ethylene, propane, and iso-pentane, or alternatively, a mixture of nitrogen, methane, ethane, butanes, and iso-pentane. In embodiments, MR compositions may be provided by an additional MR storage and/or charge system (not illustrated).

Beginning at the top of the warm-end of main heat exchanger 500, a vapor MR stream 201, which may be an MR composition in a vapor state, may enter an MR multi-stage compressor system 400 and exit as four separate product streams: a third vapor MR product stream 211 and a first, second, and third liquid MR product stream 217, 218, and 219. In embodiments, MR multi-stage compressor system 400 may comprise a suction scrubber 402 and any number of compression stages so as to effectively increase the pressure of vapor MR stream 201 to a desired pressure between about 450 psig to about 650 psig. Suction scrubber 402 may be any inlet gas scrubber suitable for knocking liquids out to protect the compressor system, and further may maintain a pressure between about 25 psig and about 50 psig. As illustrated in FIGS. 1-4, MR multi-stage compressor system 400 may comprise three compression stages made up of a first, second, and third stage pressure booster device 403, 406, and 409; a first, second, and third stage discharge cooler 404, 407, and 410; and a first, second, and third stage discharge separator 405, 408, and 411. The pressure booster devices may be booster compressor systems capable of increasing the pressure of the MR streams within MR multi-stage compressor system 400, the discharge coolers may be standard vapor cooling systems capable of utilizing cooling water or ambient air to lower the temperature of the MR streams within MR multi-stage compressor system 400, and the discharge separators may be standard vapor/liquid flash separation vessels capable of separating the MR streams within MR multi-stage compressor system 400 into two product streams: a vapor product stream and a liquid product stream.

When entering MR multi-stage compressor system 400, vapor MR stream 201 may enter suction scrubber 402 and exit as a scrubbed vapor MR stream 202. Scrubbed vapor MR stream 202, which has been freed of excess liquids, may enter first stage pressure booster device 403 and exit as a pressure-increased vapor MR stream 203. Pressure-increased vapor MR stream 203, which has been increased in pressure, may enter first stage discharge cooler 404 and exit as a partially-condensed vapor MR stream 204. Partially-condensed vapor MR stream 204, which has been cooled and partially condensed, may enter first stage discharge separator 405 and exit as two separate product streams: a first vapor MR product stream 205 and first liquid MR product stream 217. In embodiments, first vapor MR product stream 205 may remain within MR multi-stage compressor system 400, while first liquid MR product stream 217 may exit MR multi-stage compressor system 400.

In embodiments, first vapor MR product stream 205 may enter second stage pressure booster device 406 and exit as a pressure-increased first vapor MR product stream 206. Pressure-increased first vapor MR product stream 206, which has been increased in pressure, may enter second stage discharge cooler 407 and exit as a partially-condensed first vapor MR product stream 207. Partially-condensed first vapor MR product stream 207, which has been cooled and partially condensed, may enter second stage discharge separator 408 and exit as two separate product streams: a second vapor MR product stream 208 and second liquid MR product stream 218. In embodiments, second vapor MR product stream 208 may remain within MR multi-stage compressor system 400, while second liquid MR product stream 218 may exit MR multi-stage compressor system 400.

In embodiments, second vapor MR product stream 208 may enter third stage pressure booster device 409 and exit as a pressure-increased second vapor MR product stream 209. Pressure-increased second vapor MR product stream 209, which has been increased in pressure, may enter third stage discharge cooler 410 and exit as a partially-condensed second vapor MR product stream 210. Partially-condensed second vapor MR product stream 210, which has been cooled and partially condensed, may enter third stage discharge separator 411 and exit as two separate product streams: third vapor MR product stream 211 and third liquid MR product stream 219. In embodiments, both third vapor MR product stream 211 and third liquid MR product stream 219 may exit MR multi-stage compressor system 400.

In embodiments, third vapor MR product stream 211, having the desired pressure between about 450 psig and about 650 psig, may enter a fifth pass B1 of main heat exchanger 500 and exit as a liquefied MR stream 212. Fifth pass B1 may be an MR path disposed within main heat exchanger 500 beginning at the top of the warm-end and ending at the bottom of the cold-end. As such, third vapor MR product stream 211 may be cooled and completely condensed in main heat exchanger 500 as it travels through fifth pass B1. In embodiments, fifth pass B1 may be cooled by refrigerant passes disposed within main heat exchanger 500. The resulting liquefied MR stream 212 may have a temperature between about −270° F. to about −250° F., allowing for complete liquefaction of third vapor MR product stream 211. Further, liquefied MR stream 212 may maintain the same or similar pressure value as that of third vapor MR product stream 211. Due to the high-pressure value of liquefied MR stream 212, the stream may enter a second pressure reduction device 413 and exit as a first cold two-phase MR stream 213. In embodiments, second pressure reduction device 413 may be a standard control valve system capable of reducing the pressure of liquefied MR stream 212 to a pressure that may be about 5 psig to about 10 psig higher than the pressure maintained at suction scrubber 402. This pressure reduction may create a Joule-Thompson effect that lowers the pressure and temperature of liquefied MR stream 212 and produces first cold two-phase MR stream 213 that contains both liquid and vapor.

In embodiments, first cold two-phase MR stream 213, having a temperature value between about −270° F. and about −250° F. and a pressure value between about 35 psig and about 60 psig, may enter a cold MR distribution separator 414 and exit as two separate cold product streams: a cold vapor MR product stream 214 and a cold liquid MR product stream 215. Cold MR distribution separator 414 may be any standard vapor/liquid flash separation vessel selected and maintained at a certain pressure and temperature similar to that of first cold two-phase MR stream 213.

In embodiments, both cold vapor MR product stream 214 and cold liquid MR product stream 215 may be routed to a first mixing device 416 disposed inside the cold-end of main heat exchanger 500. First mixing device 416 may recombine and mix the vapor and liquid streams 214 and 215 to create a vapor/liquid mixture 216, and may further distribute the mixture evenly throughout a sixth pass B2 of main heat exchanger 500. In embodiments, sixth pass B2 may be an MR path disposed within main heat exchanger 500 connecting first mixing device 416 and a second mixing device 429, such that vapor/liquid mixture 216 enters second mixing device 429. Further, sixth pass B2 may comprise finned-channels in which vapor/liquid mixture 216 is evenly distributed through to provide cooling for warm passes disposed within main heat exchanger 500, particularly for fourth pass A4 and fifth pass B1, while simultaneously being warmed as it travels through sixth pass B2.

Referring once again to first, second, and third liquid MR product streams 217, 218, and 219, each exiting MR multi-stage compressor system 400 after separation, may each undergo similar processes. In embodiments, streams 217, 218, and 219 may enter a seventh pass B3, an eighth pass B4, and a ninth pass B5 of main heat exchanger 500 and exit as a subcooled first, second, and third liquid MR product stream 220, 221, and 222, respectively. Passes B3, B4 and B5 may be MR paths disposed within main heat exchanger 500, each beginning at different points along the top of the warm-end and ending at different points below the top of the warm-end and above the cold-end. As such, first, second, and third liquid MR product streams 217, 218, and 219, may be subcooled by main heat exchanger 500 as the streams travel through passes B3, B4 and B5. In embodiments, the resulting subcooled first, second, and third liquid MR product streams 220, 221, and 222 may have temperature values between about −50° F. to about −10° F. Lowering the temperature of first, second, and third liquid MR product streams 217, 218, and 219 may reduce vapor flash after undergoing pressure reduction, which may in turn provide more refrigeration when the liquid is vaporizing.

In embodiments, subcooled first, second, and third liquid MR product streams 220, 221, and 222, having reduced temperatures and relatively high pressures, may enter a third, fourth, and fifth pressure reduction device 423, 424, and 425, and exit as a second, third, and fourth cold two-phase MR product stream 223, 224, and 225, respectively. Third, fourth, and fifth pressure reduction devices 423, 424, and 425 may be standard control valve systems capable of reducing the pressure of subcooled first, second, and third liquid MR product streams 220, 221, and 222 to a pressure between about 30 psig and about 55 psig. Similarly to liquefied MR stream 212, this pressure reduction of streams 220, 221, and 222 may create a Joule-Thompson effect that lowers the pressure and temperature of streams 220, 221, and 222 and produces second, third, and fourth cold two-phase MR product stream 223, 224, and 225, respectively, containing both liquid and vapor. Second, third, and fourth cold two-phase MR product streams 223, 224, and 225 may be comingled into a combined two-phase stream 226, which will consequently also contain both liquid and vapor.

In embodiments, combined two-phase stream 226, having a temperature value between about −50° F. and about −10° F. and a pressure value between about 30 psig and about 55 psig, may enter a warm MR distribution separator 427 and exit as two separate product streams: a vapor MR product stream 227 and a liquid MR product stream 228. Warm MR distribution separator 427 may be any standard vapor/liquid flash separation vessel deliberately selected and maintained at a certain pressure and temperature similar to that of combined two-phase stream 226. In embodiments, both vapor MR product stream 227 and liquid MR product stream 228 may be routed to second mixing device 429 disposed within main heat exchanger 500. Second mixing device 429 may recombine and mix the vapor and liquid streams 227 and 228 as well as incorporate vapor/liquid mixture 216 to create a comingled MR mixture 229, and may further distribute the mixture evenly throughout a tenth pass B6 of main heat exchanger 500. In embodiments, tenth pass B6 may be an MR path disposed within main heat exchanger 500 connecting second mixing device 429 to a point along the top of the warm-end. Further, similarly to sixth pass B2, tenth pass B6 may comprise finned-channels in which commingled MR mixture 229 is evenly distributed through to provide cooling for warm passes disposed within main heat exchanger 500, particularly for first pass A1, fourth pass A4, fifth pass B1, seventh pass B3, eighth pass B4, and ninth pass B5, while simultaneously being warmed as it travels through tenth pass B6. In embodiments, commingled MR mixture 229 may be partially or fully vaporized upon exiting main heat exchanger 500, at which point commingled MR mixture 229 becomes vapor MR stream 201 and another cycle in the closed-loop mixed refrigeration system may begin.

FIGS. 5-8 illustrate embodiments of the natural gas liquefaction system in which closed-loop refrigeration portion 200 comprises the closed-loop gaseous nitrogen expansion (nEXP) refrigeration system. Such embodiments may enable the natural gas liquefaction system to complete full refrigeration cycles with low energy consumption. Further, such embodiments may contribute to simplicity, enhanced safety, increased reliability, and ease of operation. For instance, the nEXP refrigeration system may utilize environmentally friendly inert nitrogen gas that may provide considerable flexibility in handling load changes, temporary (cold) plant shutdowns, and/or rapid restarts.

In embodiments, the nEXP refrigeration system may utilize and circulate a solely nitrogen refrigerant, as opposed to the mixed refrigerant composition used in the closed-loop single mixed refrigerant system. Additionally, the nEXP refrigeration system may comprise a nitrogen refrigeration compander 700. Nitrogen refrigeration compander 700 may be a compact, integrated rotating equipment system, powered by a driver motor 701 (e.g. an electrical motor or gas turbine motor), comprising multiple stages of compressors and expanders to contribute in providing refrigeration to the natural gas liquefaction system. Further, nitrogen refrigeration compander 700 may integrate all stages of nitrogen compressions and expansions into a single bull-gear with a common lubrication system and a common seal gas system. In embodiments, nitrogen refrigeration compander 700 may contribute to a reduction in foot-print design, capital expenditures, and operating expenditures, as well as an increase in system efficiency, reliability, and operability.

An embodiment of nitrogen refrigeration compander 700 that may be utilized in the nEXP refrigeration system may comprise a first and second stage centrifugal compressor 702 and 704 connected via a first pinion 722, a third stage centrifugal compressor 706 and a warm expander 714 connected via a second pinion 724, and a fourth stage centrifugal compressor 708 and a cold expander 715 connected via a third pinion 726. Further, first, second, and third pinions 722, 724, and 726 may comprise a first, second, and third pinion-gear 732, 734, and 736, respectively, which may be geared to a bull-gear 740, held in place by first, second, and third thrust collars 742, 744, and 746, and driven by driver motor 701. Further, pinions 722, 724, and 726 may comprise seals and journal bearings (not illustrated). By this configuration, warm and cold expanders 714 and 715 may be installed at different pinion-gears within nitrogen refrigeration compander 700 so as to provide flexibility to the compander arrangement. For instance, warm and cold expanders 714 and 715 may be mounted to separate pinion-gears so as to allow for different revolution speeds among the expanders, therefore providing an ability to achieve high isentropic efficiency for each expander. This configuration may further reduce the load of the gearing and allow for higher or lower compressor loads than what may be accomplished in standard expander-compressor arrangements in which compressor power may be determined by expander power.

Referring to FIGS. 5-8, beginning at the top of the warm-end of main heat exchanger 500, a combined warm nitrogen stream 601 may enter first stage centrifugal compressor 702 in nitrogen refrigeration compander 700 and exit as a first pressure-increased nitrogen stream 602. First stage centrifugal compressor 702 may be any compressor capable of increasing the pressure of combined warm nitrogen stream 601. In embodiments, first pressure-increased nitrogen stream 602 may enter a first cooling device 703 and exit as a first cooled nitrogen stream 603. First cooling device 703 may be any gaseous cooling system capable of decreasing the temperature of first pressure-increased nitrogen stream 602. This process may repeat for any number of stages until the stream has reached a final high pressure between about 600 psig and about 900 psig, and a final low temperature between about 60° F. and about 120° F. In embodiments, first cooled nitrogen stream 603, a second cooled nitrogen stream 605, and a third cooled nitrogen stream 607 may enter second, third, and fourth stage centrifugal compressor 704, 706, and 708, exit as a second, third, and fourth pressure-increased nitrogen stream 604, 606, and 608, and enter a second, third, and fourth cooling device 705, 707, and 709, respectively. A resulting fourth cooled nitrogen stream 609, exiting fourth cooling device 709, may have the final high pressure and the final low temperature desired before entering main heat exchanger 500.

In embodiments, fourth cooled nitrogen stream 609 may be split into two streams, a first split stream 610 and a second split stream 611, before entry into main heat exchanger 500. Each split stream 610 and 611 may have a portion of fourth cooled nitrogen stream 609. In embodiments, first and second split stream 610 and 611 may enter an eleventh pass C1 and a twelfth pass C2 of main heat exchanger 500, and exit as a first and second cooled split stream 612 and 613, respectively. Passes C1 and C2 may be refrigerant paths disposed within main heat exchanger 500, each beginning at different points along the top of the warm-end and ending at different points below the top of the warm-end and above the cold-end. As such, first and second split stream 610 and 611 may be cooled in main heat exchanger 500 as the streams travel through passes C1 and C2. In embodiments, the resulting first cooled split stream 612 may have a temperature value between about −30° F. and about 0° F. and the resulting second cooled split stream 613 may have a temperature value between about −125° F. to about −90° F.

In embodiments, first and second cooled split streams 612 and 613, having reduced temperatures, may enter warm expander 714 and cold expander 715 disposed within nitrogen refrigeration compander 700, and exit as a first and second expanded nitrogen stream 614 and 615, respectively.

Warm and cold expanders 714 and 715 may each be a system capable of expanding both first and second cooled split streams 612 and 613 through a near-isentropic process such that the streams may reach low temperatures and low pressures. Further, warm and cold expanders 714 and 715 may provide refrigeration at the warm-end and cold-end of main heat exchanger 500 with their discharge streams 614 and 615 at different temperatures, and therefore the efficiency and operability of main heat exchanger 500 may be improved. Resulting first expanded nitrogen stream 614 may have a low temperature value between about −180° F. and about −150° F. and second expanded nitrogen stream 615 may have a low temperature value between about −270° F. to about −250° F., while both streams have low-pressure values between about 80 psig and about 120 psig.

In embodiments, first and second expanded nitrogen streams 614 and 615, having a decreased temperature and pressure, may enter a thirteenth pass C3 and a fourteenth pass C4 of main heat exchanger 500 and exit as a first and second warmed nitrogen stream 616 and 617. Thirteenth pass C3 may be a refrigerant path disposed within main heat exchanger 500 beginning at a point above the bottom of the cold-end and below the warm-end, and ending at the top of the warm-end. Additionally, fourteenth pass C4 may be a refrigerant path disposed within main heat exchanger 500 beginning at the bottom of the cold-end and ending at the top of the warm-end. In embodiments, both first and second expanded nitrogen streams 614 and 615 may flow in passes C3 and C4 to provide cooling to warm passes disposed within main heat exchanger 500, particularly for first pass A1, fourth pass A4, eleventh pass C1, and twelfth pass C2, while simultaneously being warmed as they travel through their respective passes. The resulting first and second warmed nitrogen streams 616 and 617, after exiting main heat exchanger 500, may be comingled into a single stream which becomes combined warmed nitrogen stream 601 and another cycle in the nEXP refrigeration system may begin.

Although the present invention and its advantages have been described in detail, it should be understood that various changes, substitutions and alterations may be made herein without departing from the spirit and scope of the invention as defined by the appended claims.

What is claimed is:

1. A natural gas liquefaction method comprising:

(A) introducing a natural gas stream into a natural gas liquefaction system, wherein the natural gas liquefaction system comprises:

a natural gas (NG)-to-liquefied natural gas (LNG) portion; and a closed-loop refrigeration portion comprising a closed-loop single mixed refrigerant system;

wherein the NG-to-LNG portion and the closed-loop refrigeration portion are joined by a heat exchanger;

(B) passing the natural gas stream through the NG-to-LNG portion to provide a liquified natural gas stream and a vaporized natural gas liquid stream; and (C) circulating a mixed refrigerant (MR) composition through the closed-loop single mixed refrigerant system to provide cooling to the NG-to-LNG portion, wherein the circulating step (C) comprises:

(i) introducing the MR composition in vapor form into an MR multi-stage compressor system to provide a first, second, and third liquid MR product stream, and a vapor MR product stream;

(ii) cooling the vapor MR product stream via the heat exchanger to provide a liquefied MR stream;

(iii) lowering the pressure and temperature of the liquefied MR stream via a first pressure reduction device to provide a first cold two-phase MR stream;

(iv) separating the first cold two-phase MR stream via a first MR distribution separator to provide a cold vapor MR product stream and a cold liquid MR product stream;

(v) mixing the cold vapor MR product stream and the cold liquid MR product stream via a first mixing device, wherein the first mixing device is disposed within the heat exchanger to provide a vapor/liquid mixture, wherein the vapor/liquid mixture is evenly passed through finned-channels in the heat exchanger to provide cooling to the NG-to-LNG portion;

(vi) cooling the first, second, and third liquid MR product streams via the heat exchanger to provide a cooled first, second, and third liquid MR product stream, respectively;

(vii) lowering the pressure and temperature of the cooled first, second, and third liquid MR product streams via a second, third, and fourth pressure reduction device to provide a second, third, and fourth cold two-phase MR product stream, respectively;

(viii) comingling the second, third, and fourth cold two-phase MR product streams to provide a combined two-phase stream;

(ix) separating the combined two-phase stream via a second MR distribution separator to provide a second vapor MR product stream and a fourth liquid MR product stream; and (x) mixing the second vapor MR product stream, the fourth liquid MR product stream, and the vapor/liquid mixture via a second mixing device, wherein the second mixing device is disposed within the heat exchanger to provide a comingled MR mixture, wherein the comingled MR mixture is evenly passed through finned-channels in the heat exchanger to provide further cooling to the NG-to-LNG portion.

* * * * *